US006601316B2

(12) United States Patent
Shaw, II

(10) Patent No.: US 6,601,316 B2
(45) **Date of Patent: *Aug. 5, 2003**

(54) SELECTIVELY JOINED HAIR DRYING APPARATUS AND METHOD FOR DRYING HAIR

(76) Inventor: James Malcomb Shaw, II, 850 Haven Oaks Ct., Atlanta, GA (US) 30342

( * ) Notice: Subject to any disclaimer, the term of this patent is extended or adjusted under 35 U.S.C. 154(b) by 0 days.

This patent is subject to a terminal disclaimer.

(21) Appl. No.: 10/234,862

(22) Filed: Aug. 16, 2002

(65) Prior Publication Data

US 2003/0041471 A1 Mar. 6, 2003

Related U.S. Application Data

(63) Continuation-in-part of application No. 09/946,100, filed on Sep. 4, 2001.

(51) Int. Cl.[7] ..... A45D 20/00
(52) U.S. Cl. ..... 34/98; 34/96; 34/97; 392/385
(58) Field of Search ..... 34/96, 97, 98; 392/380, 383, 384, 385; 132/271

(56) References Cited

U.S. PATENT DOCUMENTS 4,297,564 A * 10/1981 Bartolad ..... 219/367
4,595,838 A * 6/1986 Kerschgens ..... 250/504 R

FOREIGN PATENT DOCUMENTS

DE 2735420 A1 * 2/1979 ..... H05B/1/02

OTHER PUBLICATIONS

VS Sassoon Hair Dryers Instruction Booklet (at least prior to Sep. 4, 2000).

Revlon Safety Instruction Booklet (at least prior to Sep. 4, 2000).

* cited by examiner

*Primary Examiner*—Pamela A Wilson
(74) *Attorney, Agent, or Firm*—Baker, Donelson, Bearman & Caldwell

(57) ABSTRACT

A hair dryer in which a first air blower (12, 82) having a mating member (44, 128) selectively engages a second air blower (14, 84) having an opposing mating member (52, 134), each air blower (12, 82) and (14, 84) having a fan motor for operating a fan and a housing (20), (22) with an air inlet and an air outlet, for selective operation for directing air in a common direction or detached for operation for directing air in independent separate directions. Mating members of a lug and recess and of a magnetically attractive plate and magnet are disclosed. A method for drying hair is disclosed.

22 Claims, 4 Drawing Sheets

SELECTIVELY JOINED HAIR DRYING APPARATUS AND METHOD FOR DRYING HAIR

The present application is a continuation-in-part of application Ser. No. 09/946,100 filed Sep. 4, 2001.

TECHNICAL FIELD

The present application relates to hair drying apparatus and methods. More particularly, the present invention is directed to hair drying apparatus with air blowers selectively joined to blow air in a common direction or detached to blow in separate independent directions and a method for drying hair using the hair drying apparatus.

BACKGROUND OF THE INVENTION

Electrical heating and air blowing dryers are a popular supplemental means for drying and styling of hair. The blown air helps speed the drying of wet hair; warm or cool air facilitates styling of the air. Conventional hand-held hair dryers contain a fan motor, a fan, and a heating coil within a hair dryer housing, and are typically controlled by a pair of switches. The fan motor draws air into the dryer housing through an air intake. The heating coil heats air entering the housing through the air intake. The fan then forcefully expels the heated air from the housing through an air outflow nozzle. The air nozzle directs the air out of the housing in a generally single stream whose direction is dictated by the orientation of the outlet nozzle. Typically, one switch regulates the amount of heat generated by the heating coil and thus the temperature of the air stream exiting the housing through the air outflow. Often, the heating switch has settings for no heat, low heat, and high heat. Another switch regulates the volume of air which the motor forcefully expels from the air outflow nozzle. Often, the blower switch has settings for low airflow, high airflow, and off. An electrical power cord extends from the dryer housing and terminates in an electrical plug which connects the hair dryer to an electrical power supply.

Conventional hair dryer are used by individual consumers as well as hair stylists to dry or style hair. For convenience, the term "stylist" is used herein to refer to any person who uses a hair dryer for drying and/or styling of hair, which person may be an individual consumer at home, traveling, or elsewhere, or may be a hair stylist at a salon, for non-limiting examples. To use the hair dryer, the stylist connects the hair dryer to an electrical power supply. The stylist selects a dryer heat setting. If the stylist requires more heat to dry or style the hair, then a high heat setting is selected. Similarly, for drying or styling which require less heat or no heat, the stylist selects the respective settings for low heat or no heat. The stylist also selects the amount of airflow to be expelled through the nozzle. If the stylist desires a greater amount of air to be expelled from the nozzle, then a high airflow setting is selected. A setting for low airflow is selected if the stylist desires a lesser amount of air to be directed from the nozzle. The stylist then holds the nozzle of the dryer in a position relatively near and pointed toward the location of the hair which is to be dried or styled. As air is drawn into the dryer housing, the heating coil (if selected) heats the air. The fan motor turns the fan to expel the air through the nozzle in a stream of air directed to a particular area of hair to be dried or styled.

Conventional hair dryers, however, expel only a single stream of air when in use. This single airstream necessarily limits the amounts of hair which may be dried or styled at any one time to hair located on a single side of the head. Drying time for all of the hair may be significant. The time for drying hair may be decreased by employing the simultaneous use of two dryers to dry the hair. However, because the stylist must then hold multiple dryers while attempting to dry and style the hair, the task of drying the hair is made more difficult.

It thus is seen that a need remains for a hair dryer and method for selectively directing air simultaneously in independent directions or in a common direction to facilitate hair drying and styling. It is to such that the present invention is directed.

BRIEF DESCRIPTION OF THE PRESENT INVENTION

The present invention provides an apparatus and method for selective engaging air blowers for directing air in a common direction or selectively in separate independent directions when drying hair. The hair dryer of the present invention comprises a first air blower and a second air blower. Each has a motor for operating a fan and a housing with an air inlet and an air outlet. The hair dryer provides means for selectively detachably engaging the first air blower and the second air blower, for communicating air in a common direction for drying hair or being detached for blowing air in independent directions for drying hair.

In another aspect, the present invention provides a method of drying hair, comprising the steps of:

(a) providing a first air blower having a mating member of a first character and a second air blower having a mating member of a second character, each of the first air blower and the second air blower have a motor for operating a fan, and a housing with an air inlet and an air outlet; and (b) connecting the opposing mating members of the first air blower and the second air blower for operating the first and the second air blowers as a single unit for directing air in a common direction.

Objects, features, and advantages of the present invention will become apparent from reading the following detailed description of the invention and claims in view of the appended drawings.

DETAILED DESCRIPTION OF THE ILLUSTRATED EMBODIMENTS

Figure 1:
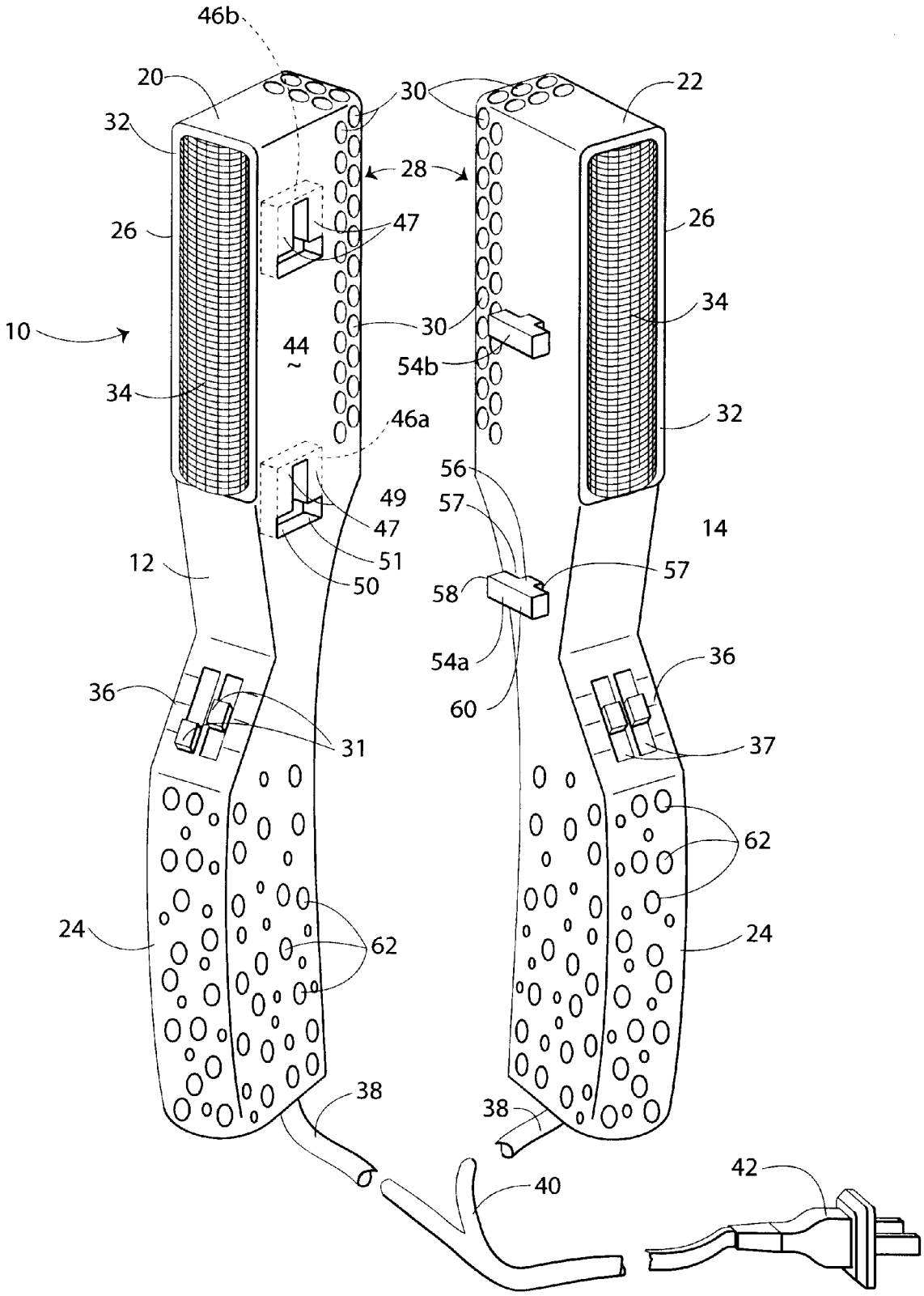
FIG. 1 illustrates a perspective view of a hair drying apparatus according to the present invention.

Referring now in more detail to the drawings, in which like numerals indicate like parts throughout the several views, there is shown a first embodiment of a hair drying device 10 in accordance with the present invention. The hair drying device 10 includes a first air blower 12 and a second air blower 14. Each blower 12, 14 has a fan motor, a heating coil, and a fan enclosed within respective blower housings 20, 22. The fan motor, heating coil, and fan of the air blowers 12, 14 are conventional and are connected by wires for electrical communication for operation, and are not otherwise particularly discussed.

The respective blower housings 20, 22 each define a handle portion generally 24 and a blower portion generally 26. The housings 20, 22 are conventional, such as comprising opposing clamshell-type members that matingly engage and fasten together to define the housings 20, 22. The blower portion 26 encloses the fan motor, the heating coil, and the fan. The blower portion 26 includes an air inlet generally 28 defined by a plurality of openings 30 and an air outlet 32 having a grid 34 through which air blown by the fan motor communicates. The openings 30 are spaced-apart on a back, opposing sides, and top of the blower portion for communicating ambient air to the fan within the blower portion.

The illustrated embodiment provides a transition portion 36 intermediate the handle portion 24 and the blower portion 26. In the illustrated embodiment, a pair of control switches 37 mount to the transition portion 36. These switches conventionally connect between an electrical cord 38 and the fan motor and the heating coil in the blower portion 26. The electrical cord 38 extends from the handle portion 24 and in the illustrated embodiment, the electrical cord 38 from each of the first air blower 12 and the second air blower 14 join at 40 for common communication in an electrical cord 41 to a conventional plug 42 for connecting to a supply of electrical current. One of the switches 37 connects to the fan motor to control selectively the amount of airflow communicated from the air outlet of the respective blower 12, 14. The other of the switches 37 connects to the heating coil to control selectively the heat of the air communicated through the blower portion 26. In the illustrated embodiments, the control switches 37 permit selection of high, low, and no heat settings and between high, low, and no (or off) airflow settings.

The first blower 12 and the second blower 14 are configured for mating engagement. In the illustrated embodiment, the first blower housing 20 includes a mating surface 44 with a pair of spaced-apart mating recesses 46*a*, 46*b* defined therein. The recesses 46*a*, 46*b* are partially closed by portions 47 of the mating surface 44, and thereby define a keyed opening 48. The portions 47 define an elongate slot 49 and lateral slots 50, 51 at an extent of the slot 49.

The second blower housing 22 includes mating surface 52 from which a pair of lugs 54*a*, 54*b* extend laterally. The lugs 54*a*, 54*b* include a stem 56 and lateral wings 58, 60 that are spaced-apart from the mating surface 52. The lugs 54*a*, 54*b* are spaced-apart in alignment with the recesses 46*a*, 46*b*. The stem 56 defines a gap 57 between a lower surface of the wings 58, 60 and the surface 52 for slidably receiving portions 47 of the mating surface 44 when engaging the air blowers 12, 14 together selectively as discussed below. The lugs 54*a*, 54*b* are configured for being received through the respective openings 48 simultaneously as discussed below. The lugs 54*a*, 54*b* thereby form keys configured for being received within the recesses 46*a*, 46*b* by passing through the openings 48 for securing the first blower 12 and the second blower 14 together as discussed below.

In the illustrated embodiment, a plurality of spaced-apart projections 62 extend from the handle portion 24 of each of the first air blower 12 and the second air blower 14. The projections 62 are generally resilient members and provide a grip for holding the handle portions 24 during use of the air blowers, as discussed below.

Figure 2:
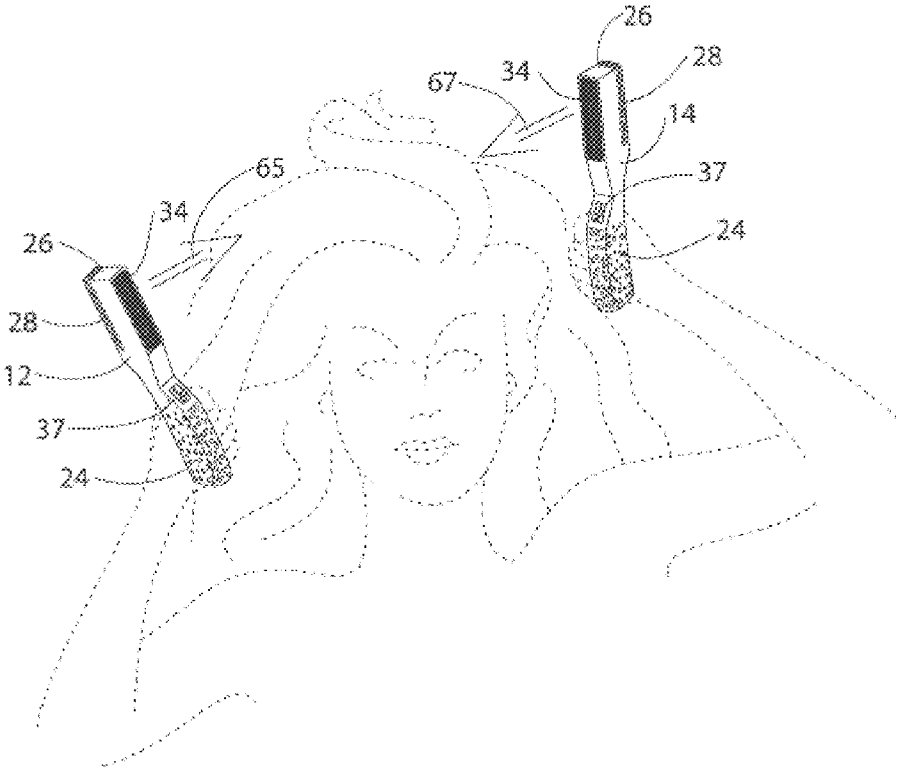
FIG. 2 is a perspective view of the hair drying apparatus shown in FIG. 1 illustrating the use thereof in a first configuration for blowing air in a common direction.

The air blowers 12, 14 are used by a hair stylist, such as an individual consumer or salon stylist, to dry and style hair of a person. In use, the air blowers 12, 14 are initially separated for drying the hair as is shown in FIG. 2. The single power cord 41 is connected through the plug 42 to an electrical power supply. The stylist adjusts the respective control switches 37 for each air blower 12, 14 so that the heating coil of each air blower 12, 14 generates the desired amount of heat and the fan motor thereof communicates the desired amount of airflow through the air outlets 32. In the illustrated embodiment, the switches 37 are 3-position slide switches for off, low, and high fan speed and off, low, and high heat settings. As with conventional hair dryers, the fan motor draws air through the air inlet 28 into the respective housing 20, 22 where the heating coil heats the air. The fan then blows the air out of the respective housing 20, 22 through the air outlet 32.

As illustrated in FIG. 2, the stylist dries the hair by holding the handle portion 24 of the first air blower 12 in one hand and the handle portion 24 of the second air blower 14 in the other hand. The air blowers 12, 14 are thereby independently operable, such as being held on opposing sides of the head of the person whose hair is being styled. The outlet 32 of the first blower 12 is oriented to direct a stream of air from the first blower 12 in a first direction such as indicated by an arrow 65 to a first area of hair to be dried. Simultaneously, the outlet 32 of the second blower 14 is positioned to direct a stream of air from the second blower 14 in a second independent direction such as indicated by an arrow 67 to a second area of hair to be dried. The two air streams thus simultaneously dry the two separate areas of hair. The stylist may move the air blowers 12, 14 in various motions for independently directing the air streams towards the hair to be dried.

Figure 3:
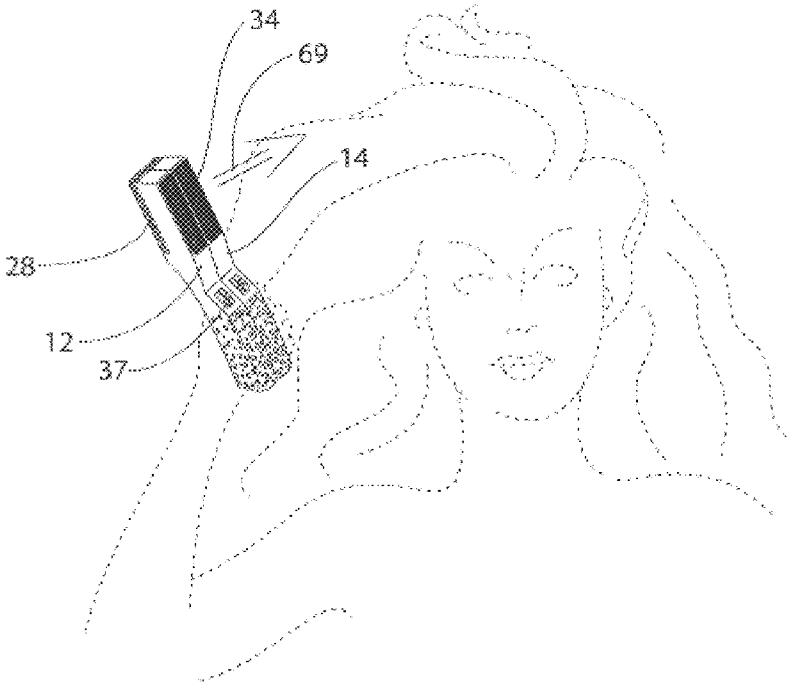
FIG. 3 is a perspective view of the hair drying apparatus shown in FIG. 1 illustrating the use thereof in a second configuration for blowing air in independent directions.

The air blowers 12, 14 are also operable in a second configuration for communicating air in a common direction, as illustrated in FIG. 3. Once the hair is sufficiently dry to permit styling, the stylist grasps the handle portions 24 of each blower 12, 14 and brings the mating surface 44 of the housing 20 and the opposing mating surface 52 of the housing 22 together for mating engagement of the first air blower 12 and the second air blower 14. This is accomplished by the recesses 46*a*, 46*b* receiving the respective lugs 54*a*, 54*b*. The opposing mating surfaces 44, 52 are aligned in longitudinally offset relation with the wings 58, 60 of the lugs 54*a*, 54*b* aligned with the lateral slots 50, 51 of the openings 48. The wings 58, 60 pass through the slots 50, 51 and into the recesses 46*a*, 46*b*. The blowers 12, 14 are then matingly engaged together by sliding the first air blower 12 longitudinally relative to the second air blower 14 in opposing directions until the lugs 54*a*, 54*b* are received within the portions of the respective recesses 46*a*, 46*b* closed by the portions 47 of the mating surface 44. The gaps 57 slidingly receive the portions 47 of the mating surface 44.

As is shown in FIG. 3, the stylist styles hair by holding the matingly engaged blowers 12, 14 in a single hand while styling the hair with the other free hand. The coupled blowers 12, 14 direct the two streams of air emitted from the first and second air blowers 12, 14 in a common direction (such as indicated by an arrow 69) to a single area of hair for styling. It is to be appreciated that although matingly engaged for blowing air in a common direction, the air blower 12 may be set for heating and blowing velocity independently of the settings for the air blower 14. Thus, the air blower 12 may be set for low heat and low volume while the air blower 14 is set for high heat and high volume, while the air is communicated in a common direction.

The matingly engaged air blowers 12, 14 may be selectively separated by sliding the air blower 12 longitudinally relative to the air blower 14 in opposing directions until the lugs 54*a*, 54*b* align with the slots 50, 51 for extraction from the recesses 46*a*, 46*b*, whereby the air blowers are detached.

It should be understood that the present invention allows for two blowers 12, 14 to be separated and used simultaneously to dry hair by blowing air independently on selected portions of the head and then selectively joined and held in one hand to direct the stream of air from each air blower 12, 14 in a common direction to a single area of the head when drying or styling the hair. The hair drying device 10 apparatus and method decreases hair drying time and is easier to operate than two separate conventional dryers.

In the illustrated embodiment, the recesses 46*a*, 46*b* are configured identically as are the lugs 54*a*, 54*b*. However, the recess 46*a* and its mating lug 54*a* could be defined differently from the recess 46*b* and its mating lug 54*b* without deviating from the invention. Additional recesses and lugs could be used. Also, it should be understood that although the embodiment depicts t-shaped lugs 54*a*, 54*b* and t-shaped openings 48 by the slots 49, 50, and 51 in the recesses 46*a*, 46*b*, for selective detachable engagement of the air blowers 12, 14, other mating configurations are gainfully used in the present invention, for example and not limited to, a cylindrical lug with an enlarged tip at its distal end for mating engagement with a circular recess that extends to a slotted key for matingly engaging the blowers 12, 14 together, hook and latch mating strips, and other selectively detachable engagements. Accordingly, the air blowers 12, 14 provide for selectively detachably engaging the two together for blowing air in a common direction or detached for blowing air in independent directions. These independent directions may be substantially the same although generally these directions will be different. In the hair dryer 10 accordingly the air blowers 12 has a mating surface of a first character and the air blower 14 has a mating surface of a second character, for matingly engaging the air blowers 12, 14 together.

Figure 4:
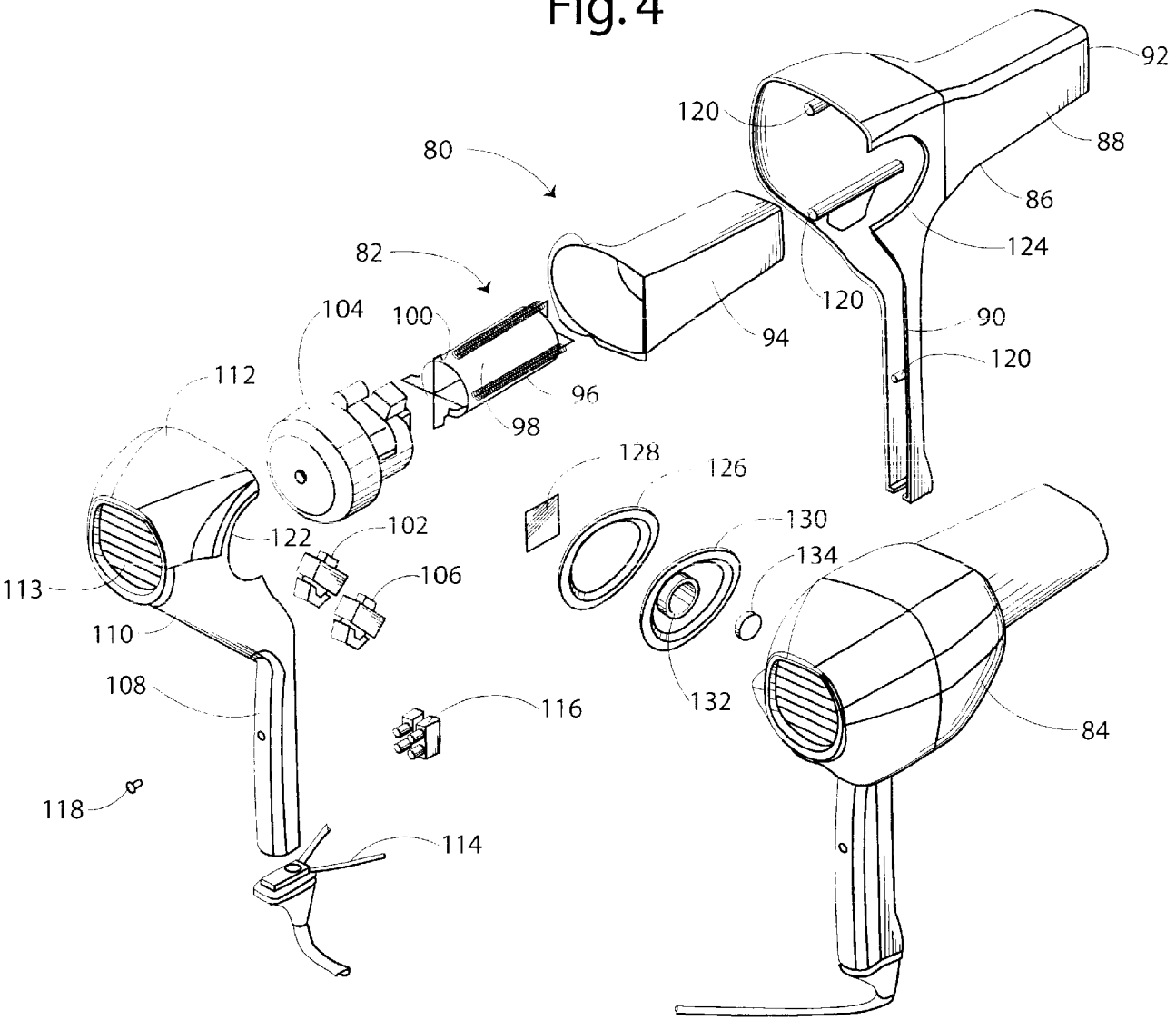
FIG. 4 illustrates a perspective partially exploded view of a second embodiment of a hair drying apparatus according to the present invention.

FIG. 4 illustrates in perspective, partially exploded view a second embodiment of a hairdryer 80 in accordance with the present invention. The hairdryer 80 has a first air blower 82 and a second air blower 84 that selectively matingly engage by magnetic coupling, as discussed below, whereby the first and second air blowers 82, 84 may be joined together for common blowing and drying of hair or separated for independent direction of blowing for drying hair.

In FIG. 4, the first air blower 82 is illustrated in exploded perspective view with a magnetically attractive plate, while the second air blower 84 is illustrated in assembled view, with a holding plate and magnet exploded therefrom, as discussed below. Accordingly, the first air blower 82 has a mating member of a first character and the second air blower 84 has a mating member of a second character, for selectively detachably joining the first and second air blowers 82, 84 together, as discussed below.

The first air blower 82 and second air blower 84 are substantially mirror image and identical, with exceptions noted below. The following discussion accordingly refers to the exploded view of the first air blower 82, with like parts in the second air blower 84. The air blower includes a front housing 86 having a nozzle portion 88 and a front handle portion 90. A distal end 92 of the nozzle 88 defines a grid-like air outlet (not illustrated) of conventional form for communicating air from the nozzle 88. The nozzle 88 slidingly receives a heat shield 94 and a heater element 96. The heater element 96 includes a heater frame 98 to which are affixed heater wires that communicate with a source of electrical current through a switch 102 as is conventional in hairdryers. A motor assembly 104 includes a fan and communicates with a switch 106. The switches 102 and 106 mount in a handle portion 108 of a rear housing 110. Operating arms of the switches 102 and 106 extend through an opening in an upper portion 112 of the rear housing 110 remote from the handle 108 for selective access when operating and using the hairdryer 80.

The upper portion 112 of the rear housing 110 further defines an air inlet 113 for communicating air into the housing for acceleration by the fan operated by the motor 104. A power supply cord extends through a strain relief 114 and connects electrically to a terminal block 116. Wires (not illustrated) from the terminal block 116 communicate with the respective switches 102, 106 for powering the heater and the fan, respectively. Screws 118 extend through openings in the rear handle and engage cylindrical stems 120 in the front housing 86. The front housing 86 and the rear housing 110 cooperatively define aligned recesses 122, 124 in a sidewall. A dished plate 126 mounts in the aligned recesses. A magnetically attractive plate 128, such as steel, attaches to an inner face of the dished plate 126. In an alternate embodiment, the dished plate 126 is magnetically attractive, thereby eliminating the steel plate 128.

Figure 5:
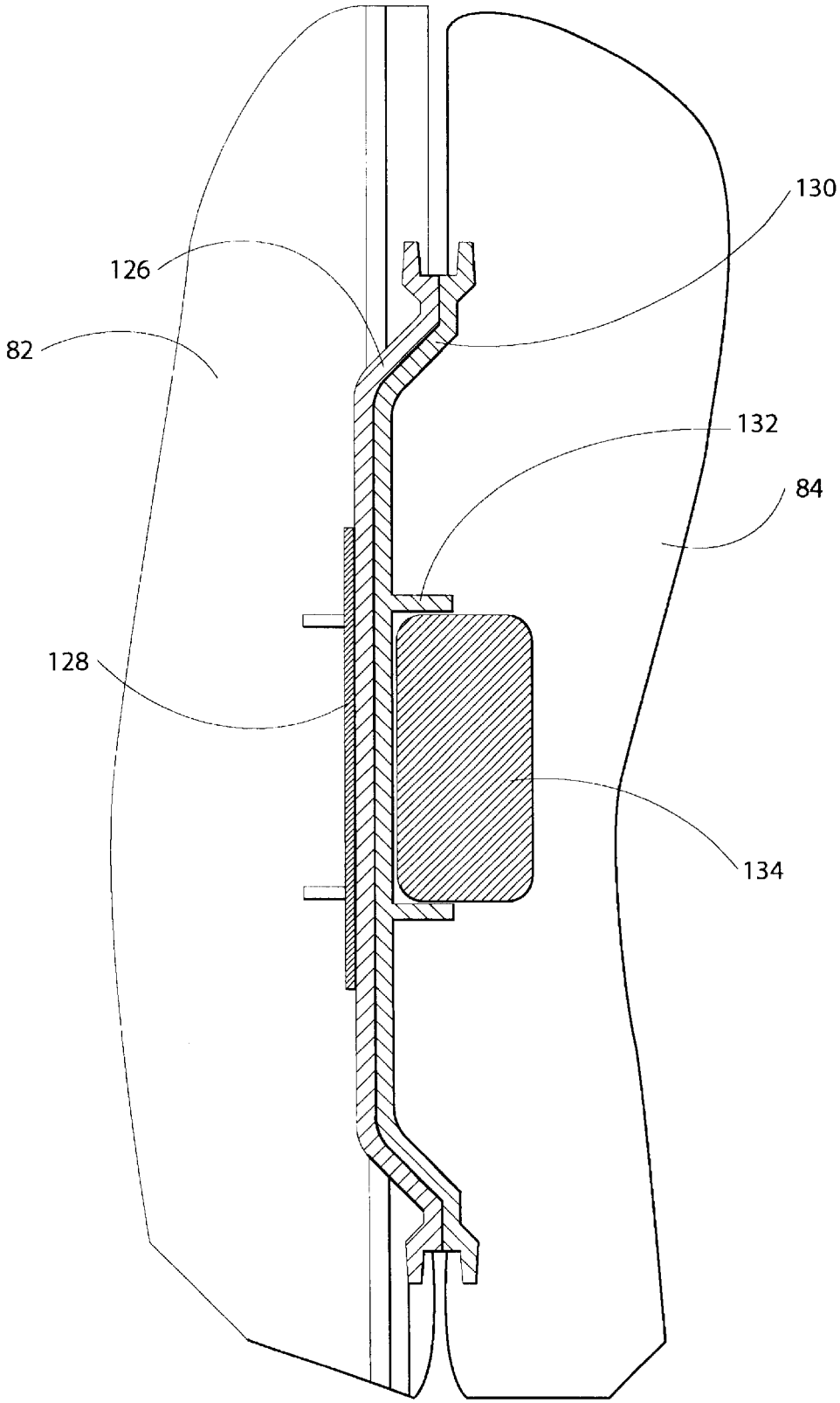
FIG. 5 illustrates in front detailed view the magnetic engagement of the air blowers illustrated in FIG. 4.

The second air blower 84 is a mirror image to the structure of the first air blower, except as to the dished plate 126 and the steel plate 128. In the second air blower 84, a second dished plate 130 mounts in the aligned recesses 122, 124. The second dished plate 130 is configured to nesting align with the first dished plate 126 of the first air blower 82 as best illustrated in FIG. 5. The second dished plate 130 includes a laterally projecting flange 132 on an inward surface which defines a receiving bowl for a magnet 134. The magnet 134 is attached by friction, adhesive, or other securing mechanism within the bowl 132.

With continued reference to FIG. 4, the first air blower 82 and the second air blower 84 are used cooperatively in accordance with the present invention, as discussed above to dry and style hair. The first air blower 82 and the second air blower 84 are operated independently and separately with adjustment of the respective control switches 102, 106 for heat and air speed. The separate air blowers 82, 84 are gripped with the handles and directed by the hair stylist to the hair of the person whose hair is being dried and styled, such as illustrated in FIG. 2. The outlets of the blowers are selectively oriented in differing directions.

The air blowers 82, 84 are also operable in a second configuration for communicating air in a common direction, such as illustrated in FIG. 3. The hair stylist brings the opposing sides of the first and second air blower 82, 84 together whereby the second dish plate 130 of the second air blower 84 nests with the dished plate 126 of the first air blower 82. The magnet 134 is attracted to the steel plate 128 and thereby detachably secures the first air blower 82 and the second air blower 84 together. The coupled first and second air blowers 82, 84 communicate air in a common direction through the distal ends 92 to a common area of hair for styling. The matingly engaged first and second air blowers 82, 84 are readily and conveniently detached from engagement by lateral pulling of the housings in opposing directions.

The present invention accordingly provides an improved hair drying device 10 and method for drying hair. The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A hair dryer, comprising:

a first air blower and a second air blower, each having a motor for operating a fan, and a housing with an air inlet and an air outlet; and means for selectively detachably engaging the first air blower and the second air blower for communicating air in a common direction or being detached for communicating air in independent directions.

2. The hair dryer as recited in claim 1, wherein means for selectively detachably engaging comprises the first air blower having a mating member of a first character and a second air blower having a mating member of a second character.

3. The hair dryer as recited in claim 2, wherein the mating member of the first character comprises a magnetically attractive plate attached to the first air blower; and wherein the mating member of the second character comprises a magnet attached to the second air blower, whereby the first blower and the second air blower are selectively joined together by magnetically engaging the magnet and the plate.

4. The hair dryer as recited in claim 3, further comprising a dished portion of a sidewall of the first air blower; and wherein the magnetically attractive plate attaches to an inward surface of the dished portion.

5. The hair dryer as recited in claim 4, further comprising a second dished portion of a sidewall of the second air blower that conforms in shape for mating alignment with the dished portion of the first air blower, the second dished portion defining a recess that receives the magnet, whereby mating alignment of the dished portion and the second dished portion engages the first and second air blowers magnetically together.

6. The hair dryer as recited in claim 2, wherein the mating member of the first character defines at least one recess that is partially closed by a portion of the housing; and wherein the mating member of the second character comprises at least one projection extending from the housing and configured for being received into the recess and held by the partially closed portion, whereby the first air blower and the second air blower are selectively joined together by engaging the projection in the recess.

7. The hair dryer as recited in claim 6, wherein the recess is a T-shaped configuration.

8. The hair dryer as recited in claim 1, wherein the first air blower and the second air blower connect though electrical cords to a common plug for engaging a supply of electrical current.

9. A hair dryer, comprising a first air blower having a mating member of a first character and a second air blower having a mating member of a second character, each of the first air blower and the second air blower have a motor for operating a fan and a housing with an air inlet and an air outlet, the first air blower and the second air blower being selectively detachably connected together by engaging the opposing mating members.

10. The hair dryer as recited in claim 9, wherein the mating member of the first character defines at least one recess that is partially closed by a portion of the housing; and wherein the mating member of the second character comprises at least one projection configured for being received into the recess and held by the partially closed portion of the housing, whereby the first air blower and the second air blower are selectively joined together by engaging the projection in the recess.

11. The hair dryer as recited in claim 10, wherein the recess is a T-shape configuration.

12. The hair dryer as recited in claim 9, wherein the mating member of the first character comprises a magnetically attractive plate attached to the first air blower; and wherein the mating member of the second character comprises a magnet attached to the second air blower, whereby the first air blower and the second air blower are selectively joined together by magnetically engaging the magnet and the plate.

13. The hair dryer as recited in claim 12, further comprising a dished portion of a sidewall of the first air blower; and wherein the magnetically attractive plate attaches to an inward surface of the dished portion.

14. The hair dryer as recited in claim 13, further comprising a second dished portion of a sidewall of the second air blower that conforms in shape for mating alignment with the dished portion of the first air blower, the second dished portion defining a recess that receives the magnet, whereby mating alignment of the dished portion and the second dished portion engages the first and second air blowers magnetically together.

15. The hair dryer as recited in claim 9, wherein the recess is a T-shape configuration.

16. The hair dryer as recited in claim 9, wherein the first air blower and the second air blower connect though electrical cords to a common plug for engaging a supply of electrical current.

17. A method of drying hair, comprising the steps of:

(a) providing a first air blower having a mating member of a first character and a second air blower having a mating member of a second character, each of the first air blower and the second air blower having a motor for operating a fan, and a housing with an air inlet and an air outlet; and (b) connecting the opposing mating members of the first air blower and the second air blower for operating the first and the second air blowers as a single unit for directing air in a common direction.

18. The method as recited in claim 17, where the step (b) connecting comprises inserting a projection from the housing of the second air blower into a recess defined in the housing of the first air blower.

19. The method as recited in claim 18, where the step (b) connecting further comprises moving the second air blower relative to the first air blower to lock the first air blower and the second air blower together.

20. The method as recited in claim 17, wherein the step (b) connecting comprises bringing a magnetically attractive plate attached to the first air blower into an attractive magnetic field created by a magnet attached to the second air blower, whereby the first and second air blowers are engaged magnetically together.

21. The method as recited in claim 17, further comprising the step of detaching the first air blower and the second air blower from engagement for independent operation thereof, whereby the first air blower and the second air blower are independently operable to direct air in respective first and second direction towards a person for drying hair.

22. The method as recited in claim 17, further comprising the step of connecting the first air blower and the second air blower though electrical cords to a common plug for engaging a supply of electrical current.

* * * * *